US011035064B2

(12) United States Patent
Yoshida et al.

(10) Patent No.: US 11,035,064 B2
(45) Date of Patent: Jun. 15, 2021

(54) WASHING AND DRYING MACHINE

(71) Applicants: Qingdao Haier Washing Machine Co., Ltd., Shandong (CN); Aqua Co., Ltd., Tokyo (JP)

(72) Inventors: Yuka Yoshida, Tokyo (JP); Shingo Hayashi, Tokyo (JP)

(73) Assignees: QINGDAO HAIER WASHING MACHINE CO., LTD.; AQUA CO., LTD.

( * ) Notice: Subject to any disclaimer, the term of this patent is extended or adjusted under 35 U.S.C. 154(b) by 372 days.

(21) Appl. No.: 16/060,729

(22) PCT Filed: Dec. 12, 2016

(86) PCT No.: PCT/CN2016/109438
§ 371 (c)(1),
(2) Date: Jun. 8, 2018

(87) PCT Pub. No.: WO2017/097264
PCT Pub. Date: Jun. 15, 2017

(65) Prior Publication Data

US 2018/0363191 A1 Dec. 20, 2018

(30) Foreign Application Priority Data

Dec. 11, 2015 (JP) ..... JP2015-242430

(51) Int. Cl.
*D06F 25/00* (2006.01)
*D06F 33/64* (2020.01)
(Continued)

(52) U.S. Cl.
CPC ..... *D06F 25/00* (2013.01); *D06F 33/63* (2020.02); *D06F 33/64* (2020.02); *D06F 58/26* (2013.01); *D06F 58/30* (2020.02); *D06F 2105/28* (2020.02)

(58) Field of Classification Search
CPC ..... D06F 25/00; D06F 58/30; D06F 33/63; D06F 33/64; D06F 33/00; D06F 33/46
See application file for complete search history.

(56) References Cited

U.S. PATENT DOCUMENTS 2,807,889 A * 10/1957 Dunkelman ..... D06F 58/30 34/546
5,161,314 A 11/1992 Souza

FOREIGN PATENT DOCUMENTS

CN 101168897 B 4/2008
CN 103572570 A 2/2014
(Continued)

OTHER PUBLICATIONS

Machine translation of JP-2005021231-A, dated Jan. 2005. (Year: 2005).*
(Continued)

*Primary Examiner* — Kevin G Lee
(74) *Attorney, Agent, or Firm* — Burns & Levinson, LLP; Joseph M. Maraia

(57) ABSTRACT

A washing and drying machine includes: a washing drum for accommodating the washings and rotating under a driving force of a motor; an air supply portion for supplying air into the washing drum; a heating portion configured to heat the air to be supplied into the washing drum when turned on and stop heating when turned off; and a control portion for controlling the motor, the air supply portion and the heating portion to execute a washing and drying operation. A drying procedure in the washing and drying operation includes main drying treatment repeated for multiple times. During each time of the main drying treatment, the control portion is configured to keep the heating portion being on within a first period, and keep the heating portion being off within a
(Continued)

second period different from the first period, and the second period is longer than the first period.

17 Claims, 3 Drawing Sheets

(51) Int. Cl.

| | |
|---|---|
| ***D06F 33/63*** | (2020.01) |
| *D06F 58/30* | (2020.01) |
| *D06F 105/28* | (2020.01) |
| *D06F 58/26* | (2006.01) |

(56) References Cited

FOREIGN PATENT DOCUMENTS

| | | | | | |
|---|---|---|---|---|---|
| EP | 1767687 | A1 | | 3/2007 | |
| EP | 1449953 | B1 | * | 9/2016 | ..... D06F 58/30 |
| JP | 2004008548 | A | | 1/2004 | |
| JP | 2005021231 | A | * | 1/2005 | |
| JP | 2007050153 | A | * | 3/2007 | |
| JP | 2008110135 | A | | 5/2008 | |
| JP | 2009028112 | A | | 2/2009 | |
| JP | 2014083389 | A | | 5/2014 | |

OTHER PUBLICATIONS

European Search Report dated Jun. 21, 2019, for Application No. 16872453.2.

* cited by examiner

| Test No. | Highest rotating speed (rpm) of the washing drum in the final dewatering procedure | Drying procedure | | | | | | Mass (g) of the washings after the drying procedure is stopped | Drying efficiency (%) | Total time (h:min) before the drying procedure is stopped |
|---|---|---|---|---|---|---|---|---|---|---|
| | | Highest rotating speed (rpm) of the washing drum in the first preparation treatment | Operation condition of each main drying treatment | | | | | | | |
| | | | Treatment time (min) | First period: turn-on time (min) of the heating portion | Second period: turn-off time (min) of the heating portion | Third period: rotating time (min) of the stirring member | Fourth period: rotating time (min) of the washing drum | | | |
| 1 | 850 | 850 | 15 | 12 | 3 | 3 | 12 | 5528 | 90.5 | 2:59 |
| 2 | ↑ | 1000 | ↑ | ↑ | ↑ | ↑ | ↑ | 5420 | 92.3 | 2:57 |
| 3 | 1000 | ↑ | ↑ | ↑ | ↑ | ↑ | ↑ | 5340 | 92.4 | 3:14 |
| 4 | ↑ | ↑ | ↑ | ↑ | ↑ | 8 | 7 | 5365 | 93.1 | 3:01 |
| 5 | ↑ | ↑ | ↑ | ↑ | ↑ | 3 | 12 | 5395 | 92.5 | 3:05 |
| 6 | ↑ | ↑ | ↑ | 7 | 8 | ↑ | ↑ | 5330 | 93.5 | 3:51 |
| 7 | ↑ | ↑ | 12 | ↑ | 5 | ↑ | 9 | 5305 | 93.9 | 3:28 |
| 8 | ↑ | ↑ | 10 | ↑ | 3 | ↑ | 7 | 5330 | 93.4 | 3:13 |
| 9 | ↑ | ↑ | ↑ | ↑ | ↑ | 8 | 2 | 5295 | 93.9 | 3:13 |
| 10 | ↑ | ↑ | 12 | ↑ | 5 | 10 | ↑ | 5285 | 94.0 | 3:26 |
| 11 | ↑ | ↑ | 5 | 3 | 2 | 3 | ↑ | 5210 | 95.2 | 3:29 |
| 12 | ↑ | ↑ | 6 | ↑ | 3 | ↑ | 3 | 5250 | 94.6 | 3:45 |
| 13 | ↑ | ↑ | 4 | ↑ | 1 | 2 | 2 | 5300 | 93.3 | 3:10 |
| 14 | ↑ | ↑ | 3 | Continuous | — | 1 | ↑ | 5335 | 92.7 | 2:52 |

FIG. 5

WASHING AND DRYING MACHINE

CROSS REFERENCE TO RELATED APPLICATIONS

This application is the U.S. national phase entry under 35 U.S.C. § 371 of International Application No. PCT/CN2016/109438, filed Dec. 12, 2016, entitled WASHING AND DRYING MACHINE, which claims priority to Japanese Patent Application No. 2015-242430, filed Dec. 11, 2015, the contents of which are incorporated herein by reference in their entirety for all purposes.

TECHNICAL FIELD

The present disclosure relates to a washing and drying machine.

BACKGROUND

In a vertical type washing and drying machine described in a following patent literature 1, a bottom-included cylindrical washing drum having an opening in an upper side is accommodated in a body housing in such a state that a central axis is vertical. Washings are thrown into the washing drum from a washing throwing opening formed in an upper surface plate of the body housing. The washing throwing opening is opened and closed through an upper cover arranged on the upper surface plate. A drying unit including a circulating air flow generation portion and a heating portion is arranged in the upper surface plate. During drying operation after the washing operation is ended, a circulating fan of the circulating air flow generation portion is driven to rotate, and a heater of the heating portion is turned on. Therefore, a circulating flow of drying air, which is circulated in such a manner of starting from the washing drum, passing through the circulating air flow generation portion, the heating portion and an air passageway arranged inside the upper cover in sequence, and returning to the washing drum is generated in the vertical type washing and drying machine. The drying air is blown to the washings in the washing drum, thereby drying the washings.

RELATED TECHNICAL LITERATURE

Patent Literature

Patent Literature 1: Japanese patent publication Laid-open No. 2014-83389

SUMMARY

In a washing and drying machine, it is expected to realize energy conservation and increase the drying efficiency for washings.

The present disclosure is completed under this background, and aims to provide a washing and drying machine capable of realizing the energy conservation and increasing the drying efficiency for the washings.

The present disclosure provides a washing and drying machine, which includes: a motor for generating a driving force; a washing drum used for accommodating washings and capable of rotating under the driving force of the motor; an air supply portion for supplying air into the washing drum; a heating portion, configured to heat the air supplied into the washing drum when turned on and stop heating when turned off; and a controller for controlling the motor, the air supply portion and the heating portion to execute a washing and drying operation. The washing and drying operation includes: a washing procedure for washing the washings; a rinsing procedure for rinsing the washings after the washing procedure; a dewatering procedure for enabling the washing drum to rotate to dewater the washings after the rinsing procedure; and a drying procedure for drying the washings after the dewatering procedure. The drying procedure includes main drying treatment repeated for multiple times. During each time of the main drying treatment, the controller is configured to keep the heating portion being on within a first period, and keep the heating portion being off within a second period different from the first period, and the second period is longer than the first period.

In addition, in the present disclosure, the washing and drying machine includes: a stirring member configured to rotate under the driving force of the motor to stir the washings in the washing drum. During each time of the main drying treatment, the controller is configured to enable the stirring member to rotate within a third period, and enable the washing drum to rotate within a fourth period different from the third period, and the fourth period is shorter than the third period.

In addition, in the present disclosure, the washing and drying machine includes: a first setting circuit for setting a highest rotating speed of the washing drum in the drying procedure to be a first set value greater than a specified value.

In addition, in the present disclosure, the washing and drying machine includes: a second setting circuit for setting a highest rotating speed of the washing drum in the dewatering procedure to be a second set value greater than the specified value.

In addition, in the present disclosure, the washing and drying machine includes: a third setting circuit for setting treatment time from start to end of each time of the main drying treatment to be a third set value less than the specified value.

According to the present disclosure, in the washing and drying machine, the washing drum used for accommodating the washings rotates under the driving force of the motor. The air supply portion supplies the air into the washing drum, and the heating portion is turned on to heat the air. The controller controls the motor, the air supply portion and the heating portion to execute the washing and drying operation.

The drying procedure in the washing and drying operation includes the main drying treatment repeated for multiple times. During each time of the main drying treatment, within the first period, the controller continuously turns on the heating portion, and within the second period different from the first period, the controller continuously turns off the heating portion. During each time of the main drying treatment, the second period is longer than the first period. Therefore, within the second period, residual heat remaining after the heating portion is turned off is used to effectively dry the washings. In addition, during each time of the main drying treatment, the second period of turning off the heating portion is longer than the first period of turning on the heating portion, so that the power consumption required by the heating portion may be reduced. According to these results, the energy conservation may be realized, and the drying efficiency for the washings may be increased.

In addition, according to the present disclosure, during each time of the main drying treatment, within the third period, the controller only enables the stirring member to rotate, and within the fourth period different from the third period, the controller only enables the washing drum to rotate. The fourth period is shorter than the third period. Through the actions of the stirring member and the washing drum, the washings in the washing drum are effectively stirred, and the heated air may be blown to all the washings. Therefore, the drying efficiency for the washings may be further increased.

In addition, according to the present disclosure, in the drying procedure that the highest rotating speed of the washing drum is set to be the first set value greater than the specified value, the washings may be effectively dried, so that the drying efficiency for the washings may be further increased.

In addition, according to the present disclosure, in the dewatering procedure that the highest rotating speed of the washing drum is set to be the second set value greater than the specified value, the washings may be effectively dewatered, so that the drying efficiency for the washings may be further increased in the drying procedure after the dewatering procedure.

In addition, according to the present disclosure, in the drying procedure that the treatment time from start to end in each time of the main drying treatment is set to be the third set value less than the specified value, the washings may be effectively dried by increasing the number of times of the main drying treatment, so that the drying efficiency for the washings may be further increased.

BRIEF DESCRIPTION OF DRAWINGS

FIG. 5 is a summary table of data related to the washing and drying operation.

LIST OF REFERENCE NUMERALS

1: washing and drying machine; 4: washing drum; 5: stirring member; 6: motor; 9: air supply portion; 10: heating portion; 30: control portion; and Q: washing.

DETAILED DESCRIPTION

Figure 1:
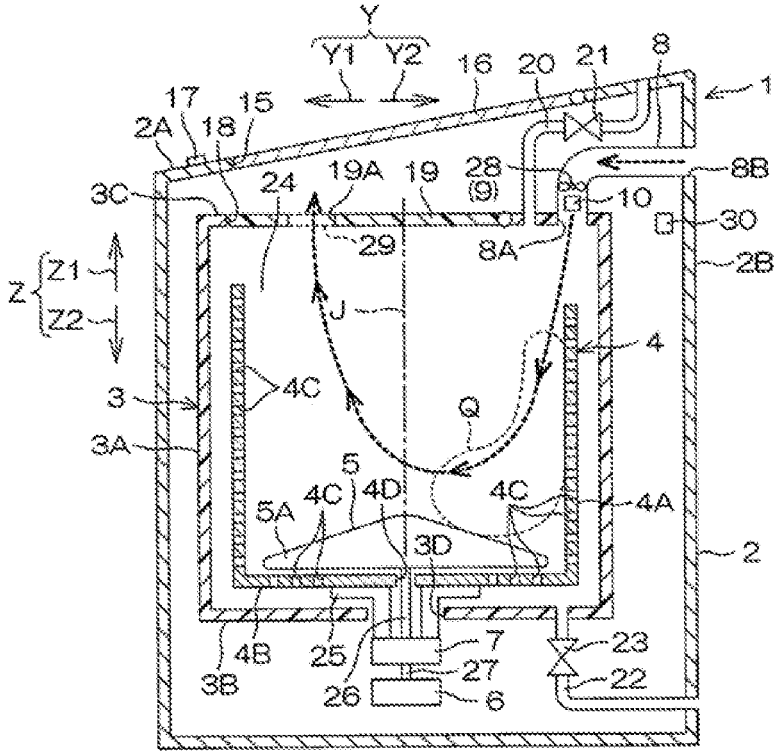
FIG. 1 is a schematic longitudinal sectional right side view illustrating a washing and drying machine according to an embodiment of the present disclosure.

An embodiment of the present disclosure is described in detail below with reference to drawings. FIG. 1 is a schematic longitudinal sectional right side view illustrating a washing and drying machine 1 according to an embodiment of the present disclosure. An up-down direction in FIG. 1 is called an up-down direction Z of the washing and drying machine 1, and a left-right direction in FIG. 1 is called a forward-backward direction Y of the washing and drying machine 1. In the up-down direction Z, an upper side is called an upper side Z1, and a lower side is called a lower side Z2. In the forward-backward direction Y, a left side in FIG. 1 is called a front side Y1, and a right side in FIG. 1 is called a rear side Y2. The washing and drying machine 1 includes: a housing 2, an outer drum 3, a washing drum 4, a stirring member 5, a motor 6, a transmission mechanism 7, a pipe 8, an air supply portion 9 and a heating portion 10.

The housing 2 is, for example, made of metal, and is formed into a box shape. An upper surface 2A of the housing 2, for example, is formed by tilting in a manner of extending towards the upper side Z1 along the rear side Y2. It should be noted that a portion constituting the upper surface 2A and the upper end portion of the rear surface 2B of the housing 2 also may be an upper surface plate, as a component different from the housing 2, and may be mounted and removed relative to the housing 2. In the upper surface plate, a portion stretching across the rear end portion of the upper surface 2A and the upper end portion of the rear surface 2B is sometimes called a backplate hereinafter. An opening portion 15 for enabling interior and exterior of the housing 2 to be communicated is formed in the upper surface 2A. The upper surface 2A is provided with a door 16 for opening and closing the opening portion 15. An operation portion 17 composed of a liquid crystal operation panel and the like is disposed in a region of the upper surface 2A, which surrounds the opening portion 15. A user can freely select operation conditions of a washing and drying operation executed in the washing and drying machine 1, or instruct the washing and drying machine 1 to start or stop the washing and drying operation by operating the operation portion 17.

The outer drum 3 is, for example, made of resin, and is formed into a bottom-included cylindrical shape. The outer drum 3 is provided with: a substantially cylindrical circumferential wall 3A disposed along the up-down direction Z, a bottom wall 3B capable of blocking a hollow portion of the circumferential wall 3A from the lower side Z2, and an annular wall 3C which seals the end edge of one side of the upper side Z1 of the circumferential wall 3A and protrudes towards the circle center of the circumferential wall 3A at the same time. An inlet/outlet 18 communicated with the hollow portion of the circumferential wall 3A from the upper side Z1 is formed in the inner side of the annular wall 3C. The inlet/outlet 18 is in such a state of being opposite to and communicated with the opening portion 15 of the housing 2 from the lower side Z2. The annular wall 3C is provided with a door 19 for opening and closing the inlet/outlet 18. The bottom wall 3B is formed into a circular plate shape substantially extending along the horizontal. A through hole 3D penetrating through the bottom wall 3B is formed in a circle center position of the bottom wall 3B.

Water is accumulated in the outer drum 3. The annular wall 3C of the outer drum 3 is connected from the upper side Z1 to a water supply path 20 connected with a water faucet of tap water so as to supply the tap water from the water supply path 20 into the outer drum 3. A water supply valve 21 opened or closed to start or stop water supplying is arranged on the water supply path 20. It should be noted that one part of the water supply path 20 may be formed in the above-mentioned upper surface plate, and other parts of the water supply path 20 also may be telescopic hoses connected with the upper surface plate and the annular wall 3C. The bottom wall 3B of the outer drum 3 is connected with a water drainage path 22 from the lower side Z2 to drain water in the outer drum 3 out of the machine from the water drainage path 22. A water drainage valve 23 opened or closed to start or stop water drainage is arranged on the water drainage path 22.

The washing drum 4 is, for example, made of metal, and is formed into a bottom-included cylindrical shape smaller than the outer drum 3 by one circle, so as to accommodate washings Q inside. The washing drum 4 is provided with: a substantially cylindrical circumferential wall 4A disposed along the up-down direction Z, and a bottom wall 4B capable of blocking a hollow portion of the circumferential wall 4A from the lower side Z2.

The inner circumferential surface of the circumferential wall 4A is the inner circumferential surface of the washing drum 4. The upper end portion of the inner circumferential surface of the circumferential wall 4A is an inlet/outlet 24 capable of enabling the hollow portion of the circumferential wall 4A to be exposed towards the upper side Z1. The inlet/outlet 24 is in such a state of being opposite to and communicated with the inlet/outlet 18 of the outer drum 3 from the lower side Z2. The user can throw in or take out the washings Q through the opened opening portion 15 and the inlets/outlets 18 and 24 from the upper side Z1 relative to the washing drum 4.

The washing drum 4 is coaxially accommodated in the outer drum 3. The washing drum 4 in the state of being accommodated in the outer drum 3 may rotate around an axis J which extends along the up-down direction Z, instead of a central axis of the washing drum 4. In addition, a plurality of through holes 4C are formed in the circumferential wall 4A and the bottom wall 4B of the washing drum 4. The water in the outer drum 3 flows between the outer drum 3 and the washing drum 4 through the through holes 4C. Therefore, the water level in the outer drum 3 is consistent with that in the washing drum 4.

The bottom wall 4B of the washing drum 4 is formed into a circular plate shape which is spaced from the bottom wall 3B at the upper side Z1 and extends in a manner of being substantially parallel to the bottom wall 3B of the outer drum 3. A through hole 4D penetrating through the bottom wall 4B is formed in the circle center position, which is consistent with the axis J, in the bottom wall 4B. The bottom wall 4B is provided with a tubular supporting shaft 25 which surrounds the through hole 4D and extends towards the lower side Z2 along the axis J. The supporting shaft 25 is inserted into the through hole 3D of the bottom wall 3B of the outer drum 3. The lower end portion of the supporting shaft 25 is located on the lower side Z2 of the bottom wall 3B.

The stirring member 5, a so-called impeller, is formed into a disk shape that takes the axis J as a circle center, and is disposed in the washing drum 4 along the bottom wall 4B in a manner of being concentric with the washing drum 4. A plurality of blades 5A disposed in a radial manner are arranged on the upper surface of the stirring member 5, which faces the inlet/outlet 24 of the washing drum 4. The stirring member 5 is provided with a rotating shaft 26. The rotating shaft 26 extends from the circle center of the stirring member 5 towards the lower side Z2 along the axis J. The rotating shaft 26 is inserted in a hollow portion of the supporting shaft 25. The lower end portion of the rotating shaft 26 is located on the lower side Z2 of the bottom wall 3B of the outer drum 3.

The motor 6 is an electric motor such as a variable frequency motor. In the housing 2, the motor 6 is configured on the lower side Z2 of the outer drum 3. The motor 6 is provided with an output shaft 27 capable of rotating around the axis J as a center, and a generated driving force is output from the output shaft 27. The transmission mechanism 7 is disposed between the lower end portions of the supporting shaft 25 and the rotating shaft 26 and the upper end portion of the output shaft 27 protruding from the motor 6 towards the upper side Z1. The transmission mechanism 7 selectively transmits the driving force output by the motor 6 from the output shaft 27 to one or both of the supporting shaft 25 and the rotating shaft 26. The transmission mechanism 7 may adopt a known member. When the driving force from the motor 6 is transmitted to the supporting shaft 25 and the rotating shaft 26, the washing drum 4 and the stirring member 5 receive the driving force of the motor 6 and thus rotate around the axis J.

In the housing 2, the pipe 8 is disposed outside the outer drum 3. The pipe 8 is, for example, formed into a tubular flowing path extending along the forward-backward direction Y on the upper side Z1 of the annular wall 3C of the outer drum 3. The front end portion of the pipe 8 is bent, and is connected to the upper end portion of the annular wall 3C from the upper side Z1. The rear end portion of the pipe 8 is located at the upper end portion of the rear surface 2B of the housing 2. In an embodiment, the rear end portion of the pipe 8 is located on the above-mentioned backplate. An outlet 8A is formed in a portion, which is connected with the annular wall 3C, in the front end portion of the pipe 8, and an inlet 8B is formed in a portion, which is located on the backplate, in the rear end portion of the pipe 8. The interior of the pipe 8 is in a state of being communicated with the interior of the outer drum 3 through the outlet 8A, and is in a state of being communicated with the exterior of the washing and drying machine 1 through an inlet 8B. It should be noted that a part of the pipe 8 may be formed in the interior of the above-mentioned upper surface plate. Other parts in the pipe 8 may be telescopic hoses connected with the upper surface plate and the annular wall 3C.

The air supply portion 9, a so-called fan, includes: rotating blades 28 disposed inside the pipe 8, and a motor (not shown in the figures) for enabling the rotating blades 28 to rotate. When the rotating blades 28 rotate, as shown in a thick dotted line arrow, after air outside the washing and drying machine 1 is sucked into the pipe 8 through the inlet 8B and then supplied into the washing drum 4 from the outlet 8A of the pipe 8 through the through hole 4C or the inlet/outlet 24 of the washing drum 4 along the upper side Z1, a flowing direction is changed, so that the air flows to the inlet/outlet 24 and the inlet/outlet 18 at the upper side Z1. A destination of the air flowing to the upper side Z1 has a door 19 for closing the inlet/outlet 18. An opening portion 19A blocked by a filter 29 is formed in the door 19. The air flowing to the upper side Z1 flows out of the outer drum 3 through the opening portion 19A, and is discharged out of the washing and drying machine 1 through a gap (not shown in the figure) formed in the housing 2. Foreign matters such as dust contained in the air are captured by the filter 29. It should be noted that although the present embodiment is different, the air also may be circulated between the pipe 8 and the outer drum 3 by connecting the inlet 8B with the outer drum 3, and then is supplied into the washing drum 4. Anyway, the air supplied into the washing drum 4 from the pipe 8 is sometimes called "air supply" below.

The heating portion 10 is a heater composed of a so-called PTC (Positive Temperature Coefficient) heater and the like, and is disposed inside the pipe 8. The heating portion 10 is turned on and electrified to emit heat, so as to heat the air supplied into the washing drum 4 from the pipe 8. In another aspect, the heating portion 10 is turned off and deenergized to not emit heat, so as to stop heating the air.

Figure 2:
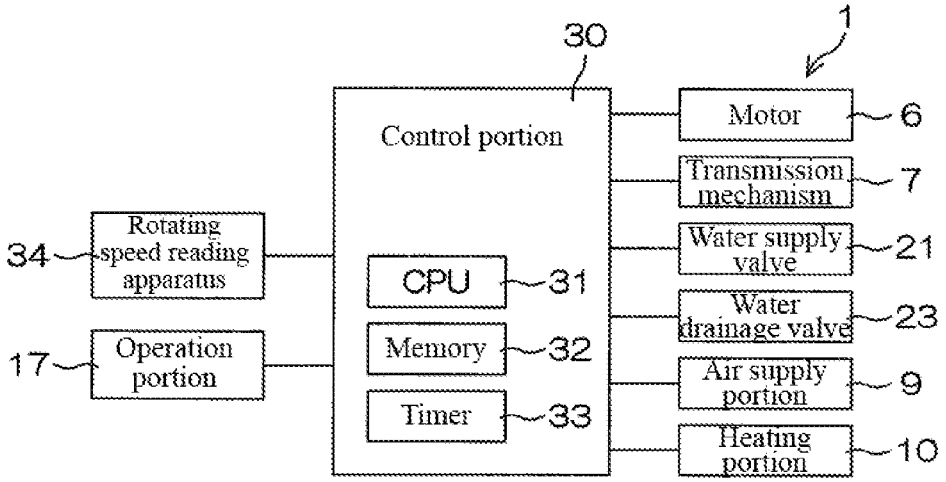
FIG. 2 is a block diagram illustrating electric structures of a washing and drying machine.

FIG. 2 is a block diagram illustrating electric structures of the washing and drying machine 1. With reference to FIG. 2, the washing and drying machine 1 includes a control portion 30 used as a controller, a first setting circuit, a second setting circuit and a third setting circuit. The control portion 30, for example, is used as a micro computer including a CPU (Central Processing Unit) 31, a memory 32 (such as an ROM (Read Only Memory) or an RAM (Random Access Memory)) and a timer 33, and is disposed in the housing 2 (with reference to FIG. 1).

The washing and drying machine 1 further includes a rotating speed reading apparatus 34. The rotating speed reading apparatus 34, the above motor 6, the transmission mechanism 7, the water supply valve 21, the water drainage valve 23, the air supply portion 9, the heating portion 10 and the operation portion 17 are respectively electrically connected to the control portion 30.

The rotating speed reading apparatus 34 is an apparatus for reading the rotating speed of the motor 6, strictly for reading the rotating speed of the output shaft 27 in the motor 6. For example, the rotating speed reading apparatus 34 is composed of a Hall IC. The rotating speed read by the rotating speed reading apparatus 34 is input into the control portion 30 in real time.

The control portion 30 controls the motor 6 by controlling a duty ratio of a voltage applied to the motor 6 on the basis of the input rotating speed, so as to enable the motor 6 to rotate at an expected rotating speed. It should be noted that in the present embodiment, the rotating speed of the washing drum 4 is the same as that of the motor 6. The rotating speed of the stirring member 5 is a value obtained by multiplying a specified constant (for example, 1/6.4) such as a reduction ratio of the transmission mechanism 7 with the rotating speed of the motor 6. Anyway, the rotating speed reading apparatus 34 may also read the rotating speeds of the washing drum 4 and the stirring member 5 respectively by reading the rotating speed of the motor 6.

The control portion 30 switches the transmission destination of the driving force of the motor 6 to one or both of the supporting shaft 25 and the rotating shaft 26 by controlling the transmission mechanism 7. The control portion 30 controls opening and closing of the water supply valve 21 and the water drainage valve 23. The control portion 30 controls the respective actions of the air supply portion 9 and the heating portion 10. When the user operates the operation portion 17 to select an operation condition and the like, the control portion 30 accepts this selection.

Figure 3:
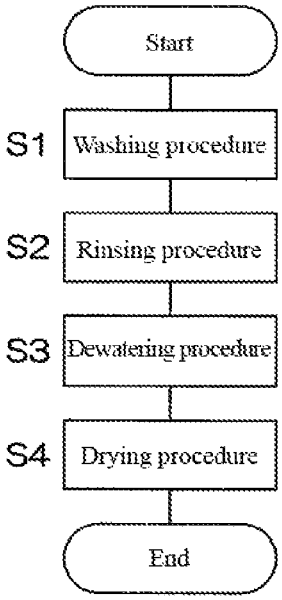
FIG. 3 is a flow chart illustrating a washing and drying operation executed in a washing and drying machine.

The control portion 30 controls actions of the motor 6, the transmission mechanism 7, the water supply valve 21, the water drainage valve 23, the air supply portion 9 and the heating portion 10, so as to execute a washing and drying operation. With reference to the flow chart shown in FIG. 3, the washing and drying operation at least includes: a washing procedure for washing the washings Q (Step S1); a rinsing procedure for rinsing the washings Q after the washing procedure (Step S2); a dewatering procedure for enabling the washing drum 4 to rotate to dewater the washings Q after the rinsing procedure (Step S3); and a drying procedure for drying the washings Q after the dewatering procedure (Step S4).

In the washing procedure of Step S1, the control portion 30 opens the water supply valve 21 for specified time, and after the water accumulated in the outer drum 3 and the washing drum 4 reaches a specified water level, makes the stirring member 5 rotate. Therefore, a mechanical force generated by the blades 5A of the rotating stirring member 5, or a mechanical force generated by a water flow produced in the washing drum 4 along with the rotation of the stirring member 5 is used to stir the washings Q in the washing drum 4. Through the stirring herein, stains may be removed from the washings Q. It should be noted that the washing drum 4 also may rotate together with the stirring member 5. In addition, a detergent may be thrown into the washing drum 4. In this case, the stains on the washings Q in the washing drum 4 are decomposed through the detergent. After the specified washing time, the control portion 30 opens the water drainage valve 23 to drain the water in the outer drum 3 and the washing drum 4, and the washing procedure is ended.

In the rinsing procedure of Step S2, the control portion 30 opens the water supply valve 21 for specified time, and after tap water accumulated in the outer drum 3 and the washing drum 4 reaches a set water level, the stirring member 5 is rotated. Therefore, the washings Q in the washing drum 4 are rinsed. After the specified rinsing time, the control portion 30 opens the water drainage valve 23 to drain the water in the outer drum 3 and the washing drum 4, and the rinsing procedure is ended. The rinsing procedure may be performed for multiple times. In this case, for example, in the rinsing procedure of an intermediate dewatering procedure (described below) performed right after the washing procedure, water spraying rinsing also may be performed, namely the tap water is supplied into the washing drum 4 rotating at low speed during water drainage, so that the washings Q are dewatered after being dipped with the tap water to squeeze out detergent liquid.

In the dewatering procedure of Step S3, in a state that the water drainage valve 23 is opened, the control portion 30 enables the washing drum 4 to rotate at a high speed, for example, at 850 rpm. A centrifugal force generated through the high-speed rotation dewaters the washings Q in the washing drum 4. The water that seeps from the washings Q through the dewatering is drained out of the machine from the water drainage path 22. It should be noted that the dewatering procedure, as the intermediate dewatering procedure, also may be performed after the washing procedure and after the rinsing procedure. In this case, like in Step S3, the finally performed dewatering procedure after the rinsing procedure is called a final dewatering procedure to distinguish the intermediate dewatering procedure. The highest rotating speed of the washing drum 4 in the final dewatering procedure may be higher than the highest rotating speed of the washing drum 4 in the intermediate dewatering procedure. Time from the start of the washing procedure to the end of the dewatering procedure is, for example, 30 to 40 minutes.

Figure 4:
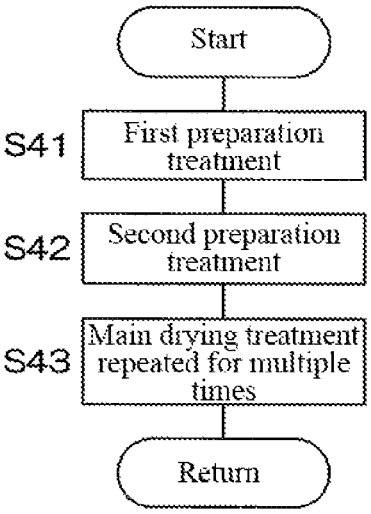
FIG. 4 is a flow chart illustrating a drying procedure in a washing and drying operation.

As a final procedure in the washing and drying operation, the drying procedure of Step S4 is performed by the control portion 30. With reference to FIG. 4 of a flow chart illustrating the drying procedure, the drying procedure includes: first preparation treatment (Step S41); second preparation treatment (Step S42) after the first preparation treatment; and main drying treatment (Step S43) repeated for multiple times after the second preparation treatment. The main drying treatment is repeated for, for example, several times to dozens of times.

In the first preparation treatment in Step S41, the control portion 30 drives the air supply portion 9 for, for example, about 50 minutes to 1 hour to enable the rotating blades 28 to rotate continuously, so as to supply air into the washing drum 4 continuously from the pipe 8 and enable the washing drum 4 to rotate. During this time, the heating portion 10 is kept turned off.

In the second preparation treatment in Step S42, in a state of supplying the air into the washing drum 4 continuously from the pipe 8, the control portion 30 turns on the heating portion 10 and repeatedly turns on and turns off the motor 6, so as to enable the washing drum 4 to intermittently rotate at low speed. At this time, the rotating speed of the washing drum 4 is, for example, 350 rpm. The second preparation treatment is performed for, for example, about 15 to 20 minutes. Through the second preparation treatment, the washings Q in the washing drum 4 are preheated and released at the same time, so that the washings Q may be effectively dried in the later main drying treatment. It should be noted that the second preparation treatment may be omitted as required.

In each time of the main drying treatment in Step S43, the control portion 30 keeps the heating portion 10 being on or off, or only enables the stirring member 5 or the washing drum 4 to rotate. It should be noted that for the rotation of the stirring member 5 herein, the control portion 30 performs the following circulation repeatedly for multiple times. The circulation, for example, is composed of 2.0-second turning on of the motor 6 and 1.5-second turning off of the motor 6, and the stirring member 5 is rotated backward to make the rotating direction of each circulation different. During backward rotation, the rotating speed of the stirring member 5 is, for example, about 110 rpm. In addition, the rotation of the washing drum 4 herein is, for example, constant-speed rotation towards one specified direction at 350 rpm.

Within the treatment time from start to end of each time of the main drying treatment, a period of the heating portion 10 being on is called a first period, a period of the heating portion 10 being off is called a second period, a period of enabling the stirring member 5 to rotate backward by repeating the above-mentioned circulation is called a third period, and a period of only enabling the washing drum 4 to rotate is called a fourth period. The first period and the second period are alternating and different periods to make the time not overlapped, and the third period and the fourth period are alternating and different periods to make the time not overlapped. The first period and the second period may be overlapped with one or both of the third period and the fourth period respectively, and the third period and the fourth period may be overlapped with one or both of the first period and the second period respectively. It should be noted that during all the main drying treatments, within the treatment time period, the air is continuously supplied into the washing drum 4 from the pipe 8.

During each time of the main drying treatment in Step S43, within the first period, the control portion 30 keeps the heating portion 10 being on. Within the second period different from the first period, the control portion 30 keeps the heating portion 10 being off. Within the third period, the control portion 30 only enables the stirring member 5 to rotate backward. Within the fourth period different from the third period, the control portion 30 only enables the washing drum 4 to rotate. Therefore, within the first period, heat generated by the heating portion 10 in a turned-on state is directly used to dry the washings Q. Within the second period, residual heat of the heating portion 10 in a turned-off state is used to dry the washings Q. Within the third period, the stirring member 5 that rotates backward stirs the washings Q from the lower side Z2. Within the fourth period, the rotating washing drum 4 stirs the washings Q from one side of the circumferential wall 4A of the washing drum 4, namely from the outer side of a radial direction taking the axis J as a center.

To know a relationship between various operation conditions in the washing and drying operation and drying degrees of the washings Q in the drying procedure, 14 tests under different operation conditions are implemented. In each test, the washings Q having a reference mass of 5,000 g in a dried state are accommodated in the washing drum 4, and then the washing and drying operation is performed. At a time point when the power consumption from the start of the washing and drying operation reaches a specified value, for example 1,400 Wh, the washing and drying operation is stopped. That is to say, in each test, the moment when the power consumption reaches the same power consumption of 1,400 Wh is used as a reference. Since the final stage, namely the drying procedure, of the washing and drying operation is performed at a set time of stopping the washing and drying operation, this set time is the same as that of stopping the drying procedure. Then, in each test, drying efficiency and total time are measured. The drying efficiency is a value obtained by dividing the mass of the washings Q in the dried state before the washing and drying operation is started by a mass of the washings Q after the drying procedure is stopped, and the total time is a duration from the start of the washing and drying operation to the end of the drying procedure. It should be noted that the mass of the washings Q in the dried state before the washing and drying operation is started is accurately measured in each test, so that it may not just be the above-mentioned 5,000 g.

With reference to the table shown in FIG. 5, all the tests are distinguished by numbers such as test No. 1 to 14. Values on the right side of each test No. in the table shown in FIG. 5 represent: the highest rotating speed of the washing drum 4 in the final dewatering procedure, the highest rotating speed of the washing drum 4 in the first preparation treatment, an operation condition in each time of the main drying treatment, the mass of the washings Q after the drying procedure is stopped, the drying efficiency, and the total time before the drying procedure is stopped. It should be noted that for units, rpm is for rotating speed, minute is for time, g is for weight, and % is for drying efficiency. However, the unit of the total time is hour and minute. The operation condition in each time of the main drying treatment includes: the on time of the heating portion 10 equivalent to the above-mentioned first period; the off time of the heating portion 10 equivalent to the above-mentioned second period; the rotating time of the stirring member 5 equivalent to the above-mentioned third period; and the rotating time of the washing drum 4 equivalent to the above-mentioned fourth period. In addition, in the present embodiment, the treatment time is consistent with a sum of the first period and the second period, or a sum of the third period and the fourth period. In each column in the table shown in FIG. 5, "↑" means being the same as a value in the above column. In addition, in test No. 14, "continuous" in the column of the first period means that the heating portion 10 is on all the time within the treatment time, and "-" in the column of the second period means that the heating portion 10 is never turned off within the treatment time.

Test No. 5 and test No. 6 are the same about the operation conditions of the third period and the fourth period. Through comparison of the two tests, it can be known that: under a condition that the treatment time is the same, like test No. 6, if the second period is longer than the first period, namely if a proportion of the second period in the treatment time is greater than that of the first period, the drying efficiency is increased. Specifically, within the second period longer than the first period, the residual heat after the heating portion 10 is turned off is effectively used, so that the washings Q may be effectively dried. Namely, it can be known that the residual heat in the second period has a relatively great influence on the drying efficiency. In addition, during each time of the main drying treatment, the second period of the heating portion 10 being off is longer than the first period of the heating portion 10 being on, so that the power consumption required by the heating portion 10 may be reduced. Thus, at the same power consumption of 1,400 Wh, the drying efficiency of test No. 6 is higher than that of test No. 5. Therefore, energy conservation may be realized, and the drying efficiency for the washings Q may be increased.

The related operation conditions of the first period and the second period between test No. 3 and test No. 4, between test No. 8 and test No. 9, and between test No. 7 and test No. 10 are the same. According to comparison of test No. 3 and test No. 4, comparison of test No. 8 and test No. 9, and comparison of test No. 7 and test No. 10, it can be known that: if the fourth period is shorter than the third period under the condition that the treatment time is the same, i.e., if the proportion of the third period in the treatment time is greater than that of the fourth period, the washings Q in the washing drum 4 may be effectively stirred through the actions of the stirring member 5 and the washing drum 4. Therefore, the heated air may be sprayed to all the washings Q, thereby increasing the drying efficiency.

If test No. 1 is compared with test No. 2, it can be known that: if the highest rotating speed of the washing drum 4 during the first preparation treatment of the drying procedure is set to be a first set value of 1,000 rpm which is higher than a specified value of 850 rpm, the washings Q may be effectively dried in the drying procedure, thereby increasing the drying efficiency.

If test No. 2 is compared with test No. 3, it can be known that: if the highest rotating speed of the washing drum 4 in the final dewatering procedure is set to be a second set value of 1,000 rpm which is higher than the specified value of 850 rpm, the washings Q may be effectively dewatered in the final dewatering procedure, thereby increasing the drying efficiency in the drying procedure after the final dewatering procedure.

In addition, according to test No. 11 and test No. 12, it can be known that: when the treatment time from start to end in each time of the main drying treatment is set to be a third set value of 5 or 6 minutes which is shorter than a specified value of 10 minutes, the washings may be effectively dried by increasing the number of times of main drying treatment, thereby greatly increasing the drying efficiency. It should be noted that test No. 11 shows that: if the first period is shorter than the second period, the drying efficiency may be further increased. However, if test No. 11 and test No. 12 are compared with test No. 13 and test No. 14, it can be known that: if the treatment time is shortened excessively, the drying efficiency may be reduced gradually, so that a lower limit value of the third set value is for example, 5 or 6 minutes.

As mentioned above, to increase the drying efficiency, for example, in each time of the main drying treatment, the control portion 30 at least sets the second period to be longer than the first period. Then, to further increase the drying efficiency, the control portion 30 also may set the fourth period to be shorter than the third period in each time of the main drying treatment as required, set the highest rotating speed of the washing drum 4 in the drying procedure to be the above-mentioned first set value, set the highest speed of the washing drum 4 in the dewatering procedure to be the above-mentioned second set value, and set the treatment time of each time of the main drying treatment to be the above-mentioned third set value.

The present disclosure is not limited to above described embodiments, and various variations can be made within the scope disclosed by claims.

For example, the washing and drying machine 1 is configured as a vertical type washing and drying machine (with reference to FIG. 1) in which the axis J of the washing drum 4 vertically extends along the up-down direction Z, but the vertical type washing and drying machine also includes the following constitution that: the axis J slightly tilts relative to the up-down direction Z. In addition, the lower part of the outer drum 3 may also be provided with an exhaust port (not shown in the figure). In the drying procedure, the air supplied into the washing drum 4 from the outlet 8A of the pipe 8 is discharged out of the washing and drying machine 1 after flowing from the exhaust port to the exterior of the outer drum 3.

What is claimed is:

1. A washing and drying machine, comprising:

a motor for generating a driving force;

a washing drum for accommodating washings and rotating under the driving force of the motor;

an air supply portion for supplying air into the washing drum;

a heating portion, configured to heat the air supplied into the washing drum when turned on and stop heating when turned off; and a controller configured to control the motor, the air supply portion and the heating portion to execute a washing and drying operation, wherein the washing and drying operation comprises:

a washing procedure for washing the washings, a rinsing procedure for rinsing the washings after the washing procedure;

a dewatering procedure for enabling the washing drum to rotate to dewater the washings after the rinsing procedure; and a drying procedure for drying the washings after the dewatering procedure;

wherein the drying procedure comprises a first preparation treatment, a second preparation treatment occurring after the first preparation treatment, and a main drying treatment repeated for multiple times after the second preparation treatment;

wherein, during the first preparation treatment, the heating portion is configured to be kept turned off, and the controller is configured to drive the air supply portion to supply the air into the washing drum continuously and enable the washing machine to rotate;

wherein, during the second preparation treatment, in a state of supplying the air into the washing drum continuously, the controller is configured to turn on the heating portion and repeatedly turn on and turn off the motor, so as to enable the washing drum to intermittently rotate at low speed; and wherein during each time of the main drying treatment, the controller is configured to keep the heating portion being on within a first period, and keep the heating portion being off within a second period different from the first period, and wherein the second period is longer than the first period.

2. The washing and drying machine according to claim 1, further comprising:

a stirring member, configured to rotate under the driving force of the motor to stir the washings in the washing drum, wherein, during each time of the main drying treatment, the controller is configured only to enable the stirring member to rotate within a third period and only to enable the washing drum to rotate within a fourth period different from the third period, and wherein the fourth period is shorter than the third period.

3. The washing and drying machine according to claim 2, further comprising:

a first setting circuit for setting a highest rotating speed of the washing drum in the drying procedure to be a first set value greater than a specified rotating speed value.

4. The washing and drying machine according to claim 3, further comprising:

a second setting circuit for setting the highest rotating speed of the washing drum in the dewatering procedure to be a second set value greater than the specified rotating speed value.

5. The washing and drying machine according to claim 4, further comprising:

a third setting circuit for setting treatment time from start to end of each time of the main drying treatment to be a third set value less than a specified time value.

6. The washing and drying machine according to claim 3, further comprising:

a third setting circuit for setting treatment time from start to end of each time of the main drying treatment to be a third set value less than a specified time value.

7. The washing and drying machine according to claim 2, further comprising:

a second setting circuit for setting the highest rotating speed of the washing drum in the dewatering procedure to be a second set value greater than a specified rotating speed value.

8. The washing and drying machine according to claim 7, further comprising;

a third setting circuit for setting treatment time from start to end of each time of the main drying treatment to be a third set value less than a specified time value.

9. The washing and drying machine according to claim 2, further comprising:

a third setting circuit for setting treatment time from start to end of each time of the main drying treatment to be a third set value less than a specified time value.

10. The washing and drying machine according to claim 1, further comprising:

a first setting circuit for setting a highest rotating speed of the washing drum in the drying procedure to be a first set value greater than a specified rotating speed value.

11. The washing and drying machine according to claim 10, further comprising:

a second setting circuit for setting the highest rotating speed of the washing drum in the dewatering procedure to be a second set value greater than the specified rotating speed value.

12. The washing and drying machine according to claim 11, further comprising:

a third setting circuit for setting treatment time from start to end of each time of the main drying treatment to be a third set value less than a time specified value.

13. The washing and drying machine according to claim 10, further comprising:

a third setting circuit for setting treatment time from start to end of each time of the main drying treatment to be a third set value less than a specified time value.

14. The washing and drying machine according to claim 1, further comprising:

a second setting unit circuit for setting the highest rotating speed of the washing drum in the dewatering procedure to be a second set value greater than a specified rotating speed value.

15. The washing and drying machine according to claim 14, further comprising:

a third setting circuit for setting treatment time from start to end of each time of the main drying treatment to be a third set value less than a specified time value.

16. The washing and drying machine according to claim 1, further comprising:

a third setting unit circuit for setting treatment time from start to end of each time of the main drying treatment to be a third set value less than a specified time value.

17. The washing and drying machine according to claim 1, further comprising a pipe, configured to transmit the air into the washing drum; wherein the air supply portion and the heating portion are successively disposed in the pipe.

* * * * *